US005575698A

United States Patent [19]

Ogino

[11] Patent Number: 5,575,698

[45] Date of Patent: Nov. 19, 1996

[54] OUTBOARD DRIVE TRANSMISSION SYSTEM

[75] Inventor: Hiroshi Ogino, Hamamatsu, Japan

[73] Assignee: Sanshin Kogyo Kabushiki Kaisha, Hamamatsu, Japan

[21] Appl. No.: 346,397

[22] Filed: Nov. 29, 1994

[30] Foreign Application Priority Data

Nov. 29, 1993 [JP] Japan ..... 5-298656

[51] Int. Cl.[6] ..... B63H 21/28

[52] U.S. Cl. ..... 440/75; 416/129

[58] Field of Search ..... 440/75, 76, 77, 440/78, 79, 80, 81, 82, 83; 74/480 B; 416/129, 169 R, 93 A

[56] References Cited

U.S. PATENT DOCUMENTS

| | | | |
|---|---|---|---|
| 537,612 | 4/1895 | Leathers . | |
| 599,125 | 2/1898 | Fefel . | |
| 624,674 | 5/1899 | Painton . | |
| 938,911 | 11/1909 | Taylor . | |
| 1,807,254 | 5/1931 | Piano . | |
| 1,813,552 | 7/1931 | Stechauner . | |
| 1,853,694 | 4/1932 | Melcher . | |
| 2,058,361 | 10/1936 | Sherwood . | |
| 2,064,195 | 12/1936 | De Michelis . | |
| 2,347,906 | 5/1944 | Hatcher . | |
| 2,372,247 | 3/1945 | Billing . | |
| 2,672,115 | 3/1954 | Conover . | |
| 2,987,031 | 6/1961 | Odden . | |
| 2,989,022 | 6/1961 | Lundquist . | |
| 3,478,620 | 11/1969 | Shimanckas . | |
| 3,769,930 | 11/1973 | Pinkerton . | |
| 4,302,196 | 11/1981 | Blanchard | 440/75 |
| 4,529,387 | 7/1985 | Brandt . | |
| 4,540,369 | 9/1985 | Caires . | |
| 4,619,584 | 10/1986 | Brandt . | |
| 4,642,059 | 2/1987 | Nohara . | |
| 4,741,670 | 5/1988 | Brandt . | |
| 4,767,269 | 8/1988 | Brandt . | |
| 4,790,782 | 12/1988 | McCormick . | |
| 4,792,314 | 12/1988 | McCormick . | |
| 4,793,773 | 12/1988 | Kinouchi et al. . | |
| 4,795,382 | 1/1989 | McCormick . | |
| 4,828,518 | 5/1989 | Kouda et al. . | |
| 4,832,570 | 5/1989 | Solia . | |
| 4,832,636 | 5/1989 | McCormick . | |
| 4,840,136 | 6/1989 | Brandt . | |
| 4,887,982 | 12/1989 | Newman et al. . | |
| 4,887,983 | 12/1989 | Bankstahl et al. . | |
| 4,897,058 | 1/1990 | McCormick . | |
| 4,932,907 | 6/1990 | Newman et al. . | |
| 4,963,108 | 10/1990 | Koda et al. . | |
| 4,986,774 | 1/1991 | Wantz | 440/75 |
| 4,993,848 | 2/1991 | John et al. . | |
| 5,009,621 | 4/1991 | Bankstahl et al. . | |
| 5,017,168 | 5/1991 | Ackley . | |
| 5,030,149 | 7/1991 | Fujita . | |
| 5,186,609 | 2/1993 | Inoue et al. . | |
| 5,230,644 | 7/1993 | Meisenburg et al. . | |
| 5,232,386 | 8/1993 | Gifford . | |
| 5,249,995 | 10/1993 | Meisenburg et al. . | |
| 5,342,228 | 8/1994 | Magee et al. . | |
| 5,344,349 | 9/1994 | Meisenburg et al. . | |
| 5,352,141 | 10/1994 | Shields et al. . | |
| 5,366,398 | 11/1994 | Meisenburg et al. . | |

FOREIGN PATENT DOCUMENTS

| | | | |
|---|---|---|---|
| 309890 | 12/1989 | Japan | 440/75 |
| 2152164 | 7/1985 | United Kingdom | 440/75 |

*Primary Examiner*—Stephen Avila
*Attorney, Agent, or Firm*—Knobbe, Martens, Olson & Bear

[57] ABSTRACT

A transmission for a counter-rotational propeller system of a watercraft outboard drive provides an increased flow area for exhaust discharge behind the transmission within the lower unit. The transmission includes a pair of counter-rotating gears. A front clutch selectively drives an inner propulsion shaft by engaging the front gear. A rear clutch selectively drive an outer propulsion shaft by engaging either of the gears. The front clutch lies forward of the front gear and the rear clutch is interposed between the gears. The clutching mechanism thus entirely lies forward of the rear gear to provide more space for exhaust discharge flow behind the transmission.

28 Claims, 10 Drawing Sheets

OUTBOARD DRIVE TRANSMISSION SYSTEM

BACKGROUND OF THE INVENTION

1. Field of the Invention

The present invention relates in general to a marine propulsion system, and in particular to a transmission for a propulsion system of an outboard drive.

2. Description of Related Art

Many outboard drives of marine watercrafts employ forward/neutral/reverse transmissions together with a dual propeller propulsion system. Such transmissions are common in both outboard motors and in outboard drive units of inboard/outboard motors.

These transmissions typically include a driving bevel gear and a pair of oppositely rotating driven bevel gears. Each driven gear includes a hub that is journaled within a lower unit of the outboard drive. A front dog clutch of a dual clutch assembly is interposed between the pair of oppositely rotating gears. In this position, the front dog clutch moves between positions in which the clutch engages the gears. The front dog clutch selectively couples an inner propeller shaft to one of the driven gears to rotate a rear propeller in either a forward or a reverse direction.

The transmission also includes a second dog clutch that is positioned to the rear side of the rear driven gear hub. The rear clutch selectively engages corresponding teeth formed on the rear side of the hub of the rear gear to drive an outer propeller shaft. The outer propulsion shaft in turn drives a front propeller.

Such prior transmission designs tend to occupy a significant amount of space in the lower unit on the rear side of the drive shaft. The lower unit also houses an exhaust passageway for the discharge of engine exhaust.

The large size of prior transmissions used with counter-rotational propulsion systems commonly leaves less space for the exhaust passage though the lower unit. Inadequate exhaust flow area can result in higher back pressure, and engine exhaust tends not to discharge smoothly. Engine performance consequently suffers. This problem becomes more acute with larger engines. It becomes necessary to increase the flow area of the exhaust passage through the lower unit in order to discharge exhaust gas smoothly.

Lower units thus have increased in size to accommodate the larger exhaust passages with current transmission designs. An increased size in the lower unit, however, undesirably increases the resistance to fluid flow around the lower unit, i.e., undesirably increases the drag on the lower unit.

Another disadvantage associated with prior transmissions used with counter-rotational propulsion systems is that such systems rotate the rear propeller when driving the watercraft in the reverse direction. The front propeller, however, tends to block the thrust stream produced by the rear propeller and thereby inhibits the performance of the outboard drive when operated in reverse.

SUMMARY OF THE INVENTION

A need therefore exists for a transmission for a counter-rotation propulsion system which provides space for an adequately sized exhaust passage through a lower unit to discharge engine exhaust smoothly, as well as improves reverse thrust when driving in reverse.

In accordance with an aspect of the present invention, a transmission for a watercraft outboard drive selective couples a drive shaft of the outboard drive to first and second propulsion shafts. Each propulsion shaft extends from the transmission to drive a propulsion device. The transmission comprises first and second counter-rotating gears that are driven by the drive shaft. A first clutch is connected to the first propulsion shaft on a side of the first and second gears opposite of the propulsion devices. A second clutch similarly is connected to the second propulsion shaft and is coupled to the first clutch. The second clutch is interposed between the first and second gears. This arrangement of the transmission components provides more space behind the transmission for exhaust discharge than prior transmission designs do.

According to another aspect of the present invention, a transmission for a watercraft outboard drive comprises first and second counter-rotating gears and a first clutch interposed between the first and second gears. A second clutch is coupled to the first clutch and is positioned on a side of one of the gears opposite of the first clutch. An actuator is coupled to the clutches to selectively actuate the clutches to engage the gears. The actuator is positioned adjacent to the second clutch on a side of one of the gears opposite of the first clutch.

An additional aspect of the present invention relates to an outboard drive for a watercraft. The outboard drive comprises first and second propulsion shafts which extend in a rearward direction from a transmission. The first propulsion shaft drives a front propulsion device and the second propulsion shaft drives a rear propulsion device. The transmission is configured to selectively couple the propulsion shafts with a drive shaft of the outboard drive to establish a forward drive condition with both front and rear propulsion devices being driven, and to selectively couple the first propulsion shaft with the drive shaft to establish a reverse drive condition with only the front propulsion device being driven.

Yet another aspect of the invention involves a transmission for a outboard drive which comprises first and second counter-rotating gears and first and second clutches which selectively engage the gears. The clutches are adapted to reciprocate between a first position, where the first and second clutches engage the first and second gears, respectively, to a second position, where only the first clutch engages the second gear. The first clutch has fewer clutching teeth on a first portion, which engages the first gear in the first position, than on a second portion, which engages the second gear in the second position.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF A PREFERRED EMBODIMENT

Figure 1:
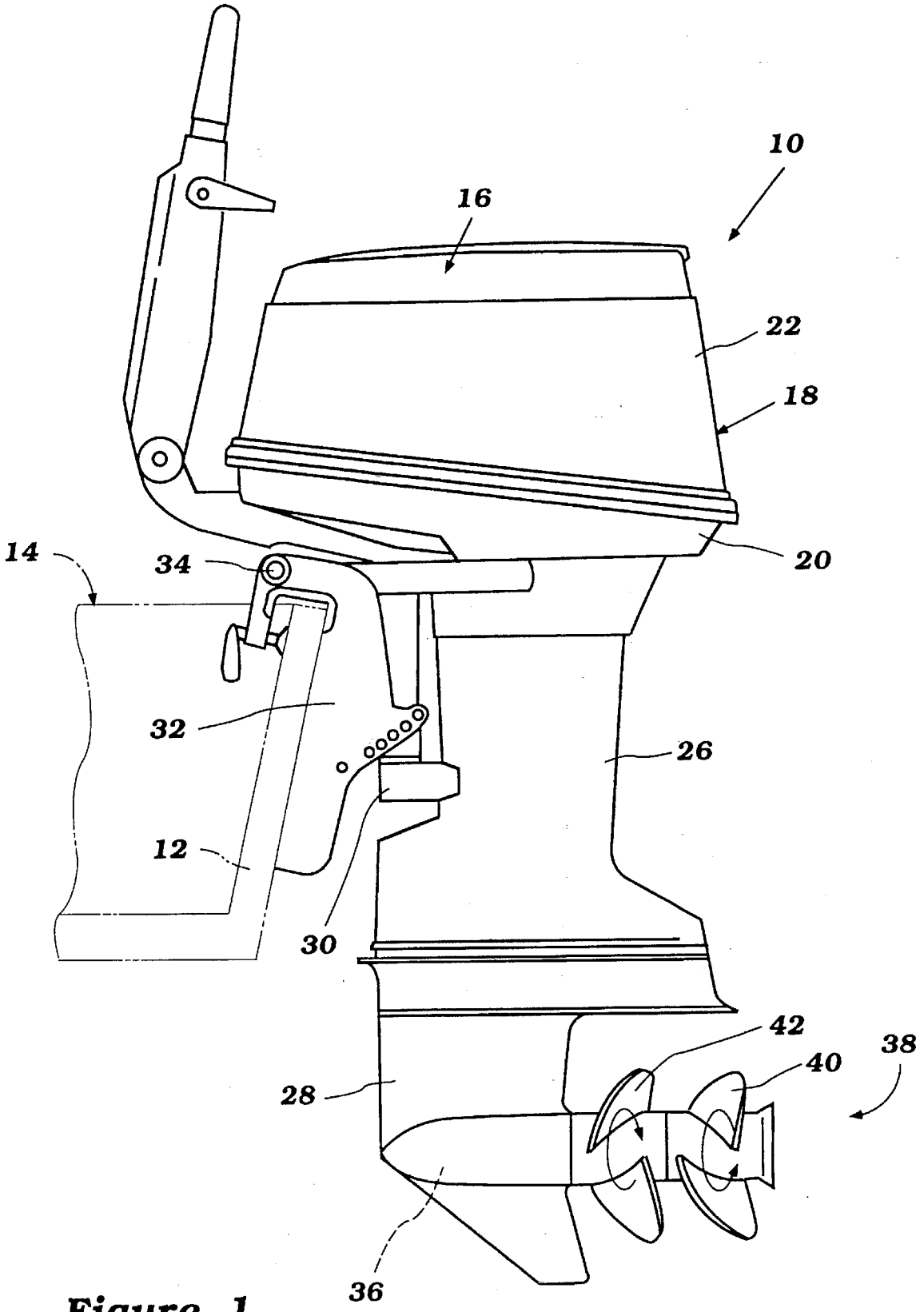
FIG. 1 is a side elevational view of a marine outboard motor configured in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a stern 12 of a watercraft 14. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 16 which includes an engine (not shown). A conventional cowling 18 desirably includes a lower tray 20 and a top cowling member 22. These components 20, 22 of the protective cowling 18 together define an engine compartment which houses the engine.

The engine is mounted conventionally with its outward shaft (i.e., a crankshaft) rotating about a generally vertical axis. The crankshaft (not shown) drives a drive shaft 24 (FIG. 2), as known in the art. The drive shaft 24 depends from the power head 16 of the outboard drive 10.

A drive shaft housing 26 extends downward from the lower tray 20 and terminates in a lower unit 28. As known in the art, the drive shaft 24 extends through and is journaled within the drive shaft housing 26.

The engine includes an exhaust system which discharges exhaust gases through an exhaust pipe (not shown). The exhaust depends from the engine, which is positioned within the cowling 18, into an exhaust expansion chamber (not shown) formed in the drive shaft housing 26.

A steering bracket 30 is attached to the drive shaft housing 26 in a known manner. The steering bracket 30 also is pivotally connected to a clamping bracket 32 by a pin 34. The clamping bracket 32, in turn, is configured to attach to the transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The lower unit 28 houses a transmission 36 which selectively establishes a driving condition of a propulsion device 38, such as, for example, a propeller, a hydrodynamic jet, or the like. The transmission 36 advantageously is a forward/neutral/reverse type transmission. In this manner, the propulsion device 38 can drive the watercraft in any of these three operating states.

The present transmission is particularly well suited for use with a counter-rotational propulsion device 38. In the illustrated embodiment, the propulsion device 38 is a counter-rotational propeller device that includes a first propeller 40 designed to spin in one direction and to assert a forward thrust, and a second propeller 42 designed to spin in an opposite direction and to assert a forward thrust.

Figure 2:
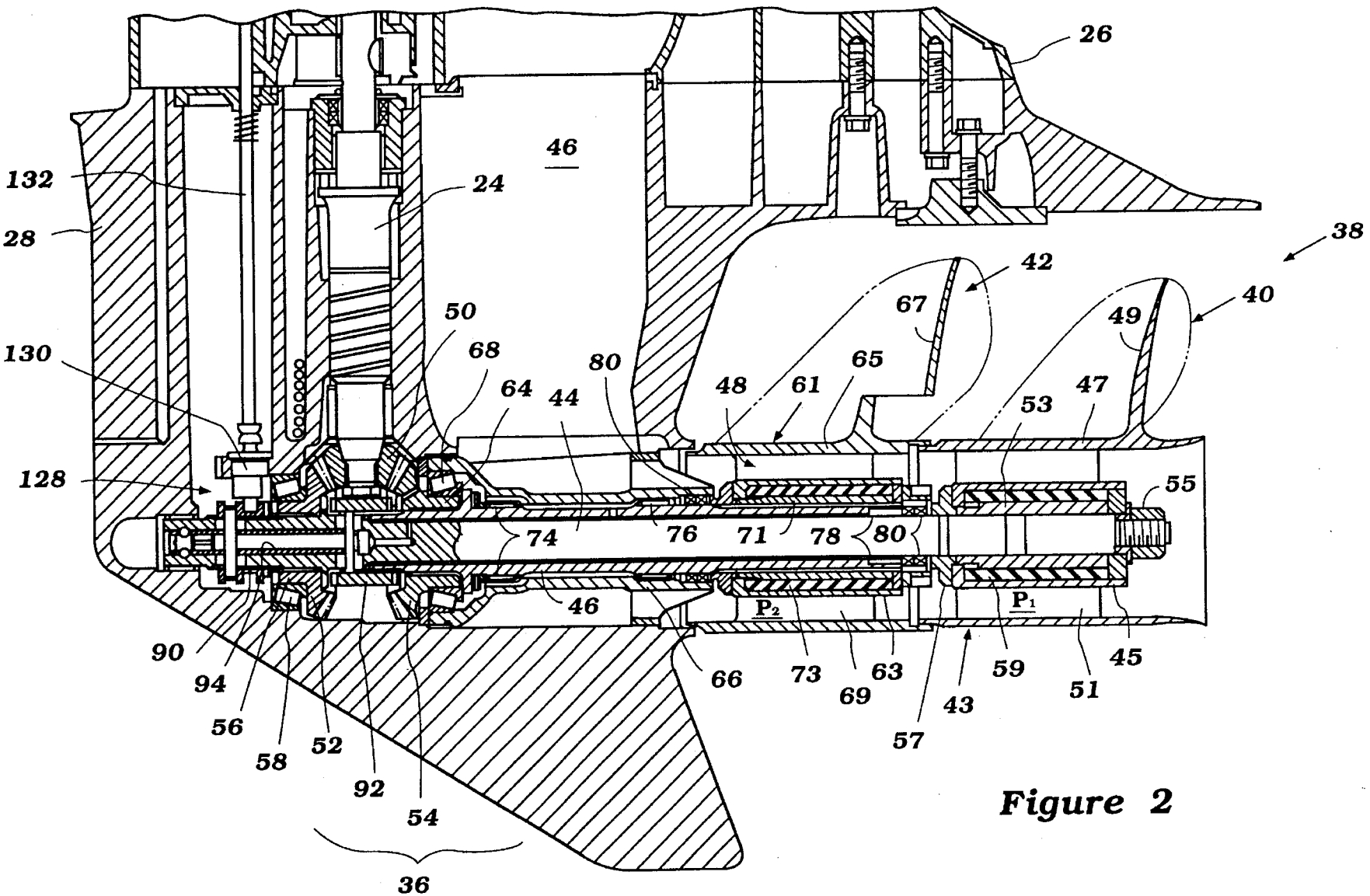
FIG. 2 is a sectional side elevational view of a lower unit of the marine outboard motor of FIG. 1.

FIG. 2 illustrates the components of the front and rear propellers 40, 42. The rear propeller 40 includes a boss 43 formed in part by an inner sleeve 45 and an outer sleeve 47 to which the propeller blades 49 are integrally formed. A plurality of radial ribs 51 extend between the inner sleeve 45 and the outer sleeve 47 to support the outer sleeve 47 about the inner sleeve 45 and to form a passage $P_1$ through the propeller boss 43. Engine exhaust is discharged through the passage $P_1$, as known in the art.

An inner propulsion shaft 44 drives the rear propeller boss 43. For this purpose, the rear end of the inner propulsion shaft 44 carries an engagement sleeve 53 which has a spline connection with the rear end of the rear propulsion shaft 44. The sleeve 53 is fixed to the rear end of the inner shaft 44 between a nut 55 threaded on the rear end of the shaft 44 and an annular retainer ring 57 positioned between the front and rear propeller 40, 42. An elastic bushing 59 is interposed between the engagement sleeve 53 and the rear propeller boss 43 and is compressed therebetween. The bushing 59 is secured to the engagement sleeve 53 by a heat process known in the art. The frictional engagement between the boss 43 and the elastic bushing 59 is sufficient to transmit rotational forces from the engagement sleeve 53, driven by the inner propulsion shaft 44 to the rear propeller blades 49.

The front propeller 42 likewise includes a front propeller boss 61. The front propeller boss 61 has an inner sleeve 63 and an outer sleeve 65. Propeller blades 67 of the front propeller 42 are integrally formed on the exterior of the outer sleeve 65. Ribs 69 connect the inner sleeve 63 and the outer sleeve 65 to form an axially extending passage $P_2$ between the sleeves 63, 65. The passage $P_2$ communicates with the passage $P_1$ of the rear propeller boss 43 so as to form a continuous exhaust discharge passage 48 through the propulsion device 38.

An outer propulsion shaft 46 carries the front propeller 42. As best seen in FIG. 2, the rear end portion of the outer propulsion shaft 46 carries a front engagement sleeve 71 and drives the engagement sleeve 71 thereabouts by a spline connection. The front engagement sleeve 71 is secured onto the outer propulsion shaft 46 between the annular retaining ring 57 and the lower unit 28.

A front annular elastic bushing 73 surrounds the front engagement sleeve 71. The bushing 73 is secured to the sleeve 71 by a heat process known in the art.

The front propeller boss 61 surrounds the elastic bushing 73, which is held under pressure between the boss 61 and the engagement sleeve 71 in frictional engagement. The frictional engagement between the propeller boss 61 and the bushing 73 is sufficient to transmit a rotational force from the sleeve 71 to the propeller blades 67 of the front propeller boss 61.

As also seen in FIG. 2, the drive shaft housing 26 and the lower unit 28 together define an exhaust discharge duct 46 which delivers engine exhaust from the expansion chamber of the drive shaft housing 26 to the exhaust discharge passage 48 formed within the propulsion device 38, as known in the art. The outlet end of the exhaust discharge passage 48 is located behind the propulsion device 38.

The individual components of the present transmission 36 will now be described in detail with reference to FIGS. 3–7. Additionally, in connection with the description of the components, "front" and "rear" are used herein in reference to the bow of the watercraft 14.

Figure 3:
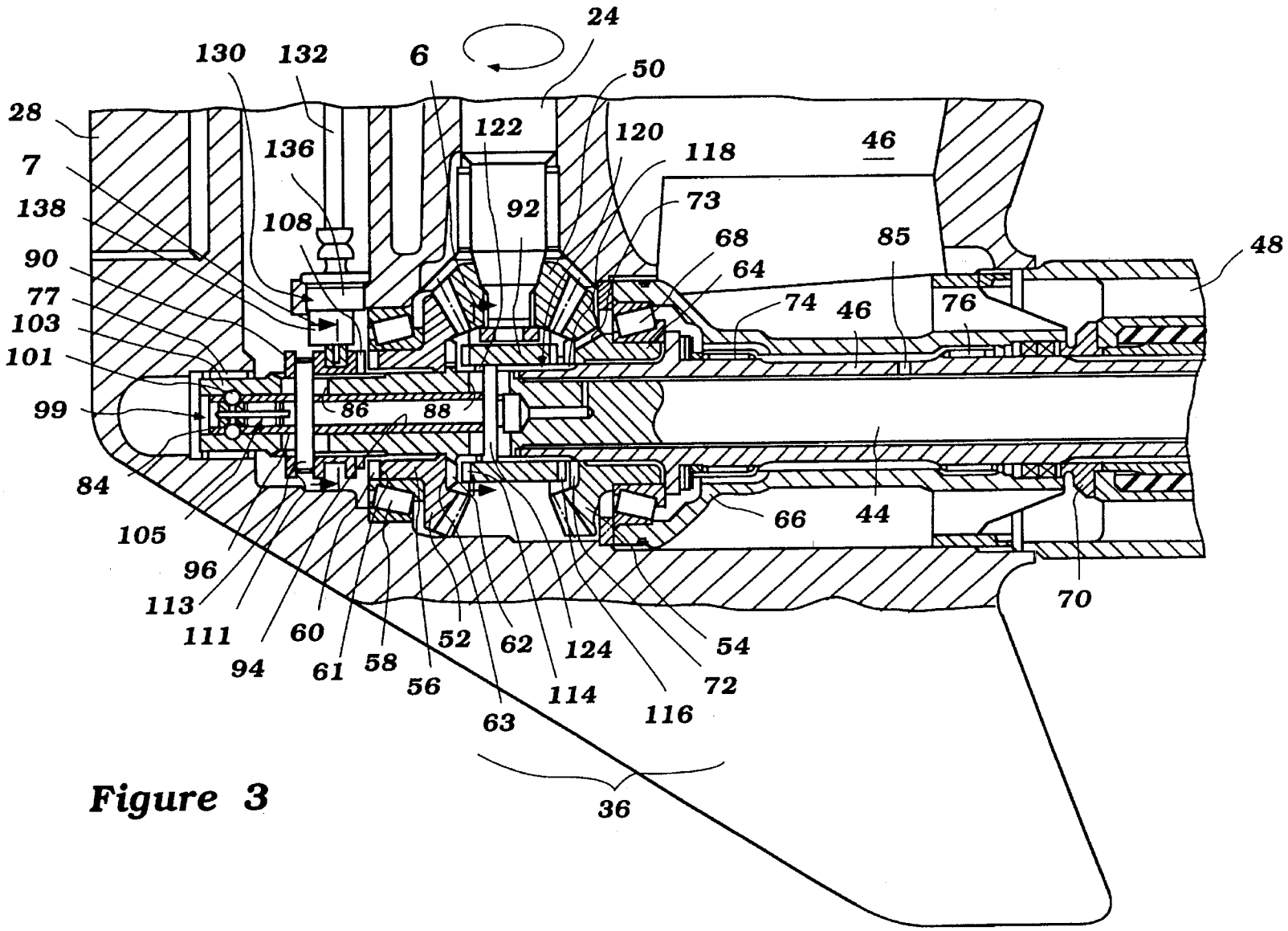
FIG. 3 is an enlarged sectional side elevational view of a transmission of the lower unit of FIG. 2.

With reference to FIG. 3, the drive shaft 24 carries a drive gear 50 at its lower end, which is disposed within the lower unit 28 and which forms a portion of the transmission 36. The drive gear 50 preferably is a bevel type gear.

The transmission 36 also includes a pair of counter-rotating driven gears 52, 54 that are in mesh engagement with the drive gear 50. The pair of driven gears 52, 54 preferably are positioned on diametrically opposite sides of the drive gear 50, and are suitably journaled within the lower unit 28 as described below. Each driven gear 52, 54 is positioned at about a 90° shaft angle with the drive shaft 24. That is, the propulsion shafts 44, 46 and the drive shaft 24 desirably intersect at about a 90° shaft angle; however, it is contemplated that the drive shaft 24 and the propulsion shaft 44, 46 can intersect at almost any angle.

In the illustrated embodiment, the pair of driven gears 52, 54 are a front bevel gear 52 and an opposing rear bevel gear 54. The front bevel gear 52 includes a hub 56 which is journaled within the lower unit 28 by front thrust bearing 58. The thrust bearing 58 rotatably supports the front gear 52 in mesh engagement with the drive gear 50.

Figure 4:
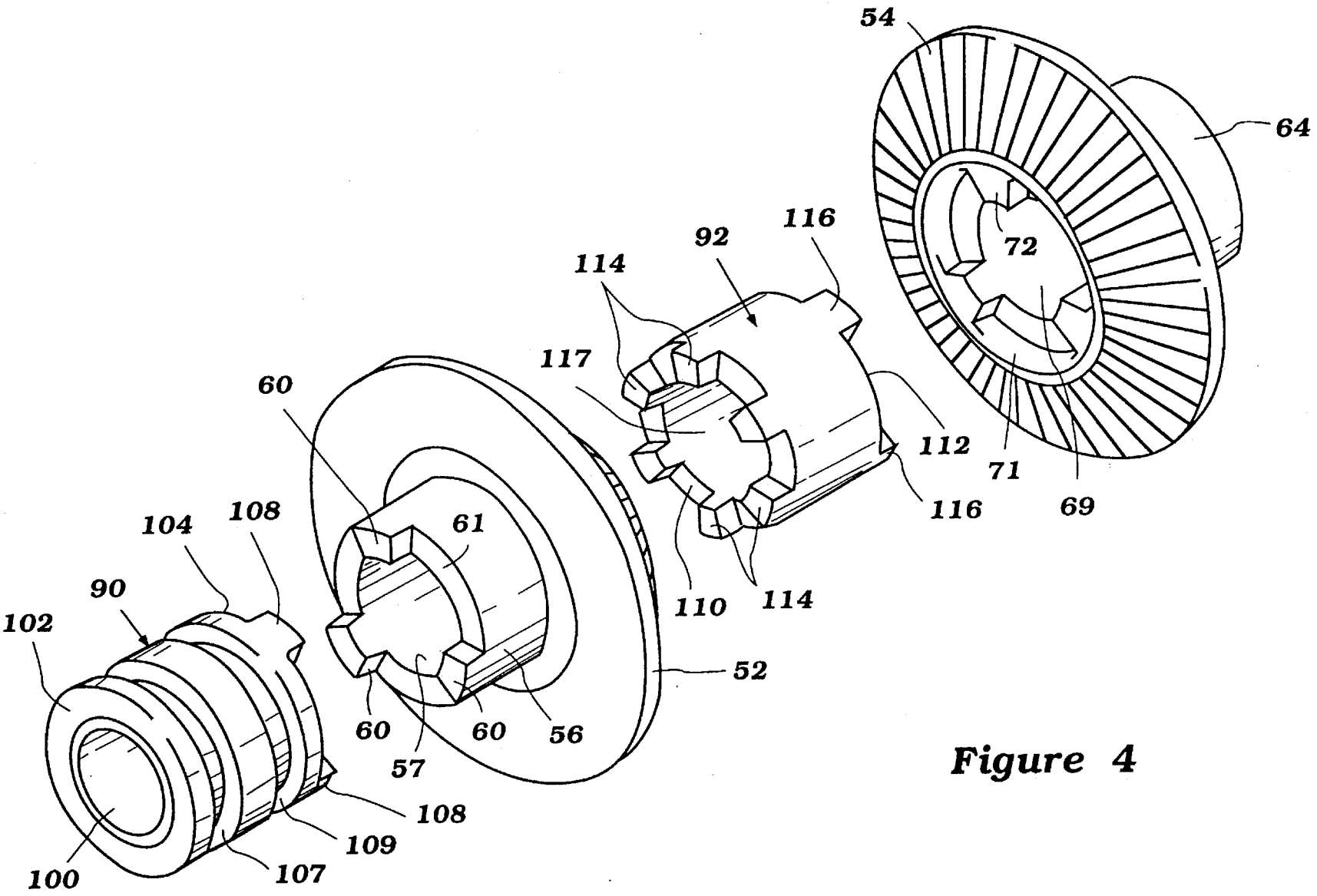
FIG. 4 is an exploded perspective view illustrating the front and rear clutches and driven gears of the transmission of FIG. 2.

As seen in FIGS. 3 and 4, the hub 56 has a central bore 57 through which the inner propulsion shaft 44 passes when assembled. The inner propulsion shaft 44 is suitably journaled within the central bore 57 of the front gear hub 56. The front gear 52 also includes a series of teeth 60 on an annular front facing engagement surface 61, and includes a series of teeth 62 on an annular rear facing engagement surface 63 (FIG. 3). The teeth 60, 62 on each surface 61, 63 positively engage a portion of a clutch of the transmission 36, as discussed below.

As seen in FIG. 3, the rear gear 54 also includes a hub 64 which is suitably journaled within a bearing casing 66 of the lower unit 28 by a rear thrust bearing 68. The rear thrust bearing 68 rotatably supports the rear gear 54 in mesh engagement with the drive gear 50. A front end ring 70, attached to the lower unit 28, secures the bearing casing 66 to the lower unit 28.

With reference to FIGS. 3 and 4, hub 64 of the rear gear 54 has a central bore 69 through which the inner propulsion shaft 44 and the outer propulsion shaft 46 pass when assembled. The rear gear also includes an annular front engagement surface 71 which carries a series of teeth 72 for positive engagement with a clutch of the transmission 36, as discussed below.

The rear gear 54 also includes a plurality of lubricant passages 73 that extend from the annular front engagement surface 71 to a location outside the bearing hub 64, proximate to the rear thrust bearing 68. These passages 73 allow lubricant flow from a main lubricant sump between the driven gears 52, 54 into the area outside of the bearing hub 64 of the rear gear 54 so as to lubricate the rear thrust bearing 68 as well as to provide a lubricant flow passageway into the bearing casing 66.

As best seen in FIG. 3, the bearing casing 66 rotatably supports the hollow outer propulsion shaft 46 within the lower unit 28. A front needle bearing 74 journals a front end of the outer propulsion shaft 46 within the bearing casing 66. A rear needle bearing 76 supports the outer propulsion shaft within the bearing casing 66 at an opposite end of the bearing casing 56 from the front needle bearing 74.

With reference to FIG. 2, on the front side of the front gear 52, a needle bearing assembly 77 journals the front end of the inner propulsion shaft 44 within the lower unit 28. The inner propulsion shaft 44 extends rearward through the front gear hub 56 and the rear gear hub 64, and is suitably journaled therein. On the rear side of the rear gear 54, the inner propulsion shaft 44 extends through the outer shaft 46 and is suitably journaled therein by a rear needle bearing assembly 78 which supports the inner shaft 44 at the rear end of the outer shaft 46.

A first pair of seals 80 (e.g., oil seals) are interposed between the bearing casing 66 and the outer propulsion shaft 46 at the rear end of the bearing casing 66. Likewise, a second pair of seals 82 (e.g., oil seals) are interposed between the inner shaft 44 and the outer shaft 46 at the rear end of the outer shaft 46. Lubricant within a lubricant sump flows through the gaps between the bearing casing 66 and the outer shaft 46, through the apertures 83, 85 in the inner and outer shafts 44, 46, and between the outer shaft 46 and the inner shaft 44 to lubricate the bearings 68, 74, 76, 78 supporting the inner propulsion shaft 44 and the outer propulsion shaft 46. The seals 80, 82, which are located at the rear end of the bearing casings 66 and at the rear end of the outer shaft 46, substantially prevent lubricant flow beyond these points.

With reference to FIG. 3, the front end of the inner propulsion shaft 44 includes a longitudinal bore 84. The bore 84 extends from the front end of the inner shaft 46 to a bottom surface which is positioned on the rear side of the axis of the drive shaft 24. The longitudinal bore 84 communicates with the lubricant opening 83 of the inner shaft 44. A front aperture 86 extends through the inner shaft 44, transverse to the axis of the longitudinal bore 84, at a position forward of the front bevel gear 52. The inner shaft 44 also includes a rear aperture 88 that extends transverse to the axis of the longitudinal bore 84 and is generally symmetrically positioned between the front bevel gear 52 and the rear bevel gear 54.

As best seen in FIG. 3, the transmission 36 also includes a front clutch 90 and a rear clutch 92 coupled to a plunger 94. As discussed in detail below, the front clutch 90 selectively couples the inner propulsion shaft to the front gear 52. The rear clutch 92 selectively couples the outer propulsion shaft 46 either to the front gear 52 or to the rear gear 54. FIG. 3 illustrates the front clutch 90 and the rear clutch 92 set in a neutral position (i.e., in a position in which the clutches 90, 92 do not engage either the front gear 52 or the rear gear 54). In the illustrated embodiment, the clutches 90, 92 are positive clutches, such as, for example, dog clutches; however, it is contemplated that the present transmission could be designed with friction-type clutches.

The plunger 94 has a generally cylindrical rod shape and slides within the longitudinal bore 84 of the inner shaft 44 to actuate the clutches 90, 92. The plunger 94 may be solid; however, it is preferred that the plunger 94 be hollow (i.e., a cylindrical tube), especially where a neutral detent mechanism of the type described below is used.

The plunger 94 includes a front hole 96 that is positioned generally transverse to the longitudinal axis of the plunger 94 and a rear hole 98 that is likewise positioned generally transverse to the longitudinal axis of the plunger 94. Each hole 96, 98 desirably is located symmetrically in relation to the corresponding apertures 86, 88 of the inner propulsion shaft 44.

The transmission 36 also may include a neutral detent mechanism 99 to hold the plunger 94 (and the coupled clutches 90, 92) in the neutral position. FIG. 3 illustrates an embodiment of the neutral detent mechanism 99 used with a hollow plunger 94 in which the detent mechanism cooperates between the plunger 94 and the inner propulsion shaft 44, and is located at the front end of the inner propulsion shaft 44.

The neutral detent mechanism is formed in part by at least one, and preferably two, transversely positioned holes in the plunger 94. These holes receive detent balls 101. The detent balls each have a diameter which is slightly smaller than the diameter of each hole.

As seen in FIG. 3, the inner propulsion shaft 44 includes an annular groove 103 which is formed on the inner wall of the bore 84 through which the plunger 94 slides. The groove 103 is positioned within the bore 84 so as to properly locate the clutches 90, 92 in the neutral position when the detent holes of the plunger 94 coincide with the axial position of the annular groove 103. A spring plunger 105, formed in part by a helical compression spring, biases the detent balls 101 radially outwardly against the inner wall of the inner propulsion shaft bore 84. The plunger 94 contains the spring plunger 105 within its bore.

The spring plunger 105 forces portions of the detent balls 101 into the annular groove 103 when the plunger 94 is moved into the neutral position. This releasable connection between the detent balls 101 carried by the plunger 94 and the groove 103 of the inner propulsion shaft 44 releasably restrains movement of the plunger 94 relative to the inner propulsion shaft 44, as known in the art. Because the detent mechanism 99 is believed to be conventional, further description of the detent mechanism 99 is thought unnecessary for an understanding of the present transmission 36.

FIG. 4 illustrates the dog clutches 90, 92 and the front and rear driving gears 52, 54 in isolation. As seen in FIG. 4, the front dog clutch 90 has a generally cylindrical shape that includes an axial bore 100 which extends between an annular front end 102 and a flat annular rear end 104. The bore 100 is sized to receive the inner propulsion shaft 44. Internal splines 106 (shown in FIG. 5) are formed on the wall of the bore 100, the purpose of which will be explained below. FIG. 4 does not illustrate the internal splines 106 in order to simplify the drawing.

The rear end surface 104 of the clutch 90 extends generally transverse to the longitudinal axis of the clutch 90. The rear surface 104 of the front dog clutch 90 is substantially coextensive in area with the annular front surface 61 of the front gear 52. Teeth 108 extend from the clutch rear surface 104 in the longitudinal direction and desirably correspond to the teeth 60 of the front surface 61 of the front gear 52 in size (e.g., axial length) and in configuration. In the illustrated embodiment, the front clutch 90 and the front gear 52 each includes three teeth 108, 60, respectively, on their corresponding ends; however, it is contemplated that the clutch 90 and gear 52 could have any of a variety of number of teeth in order to suit a specific application.

A pair of annular grooves circumscribe the exterior of the front clutch 90. A front groove 107 is sized to receive a retaining spring, as discussed below. The rear groove 109 is sized to cooperate with a portion of an actuator mechanism, which also will be described below.

Figure 5:
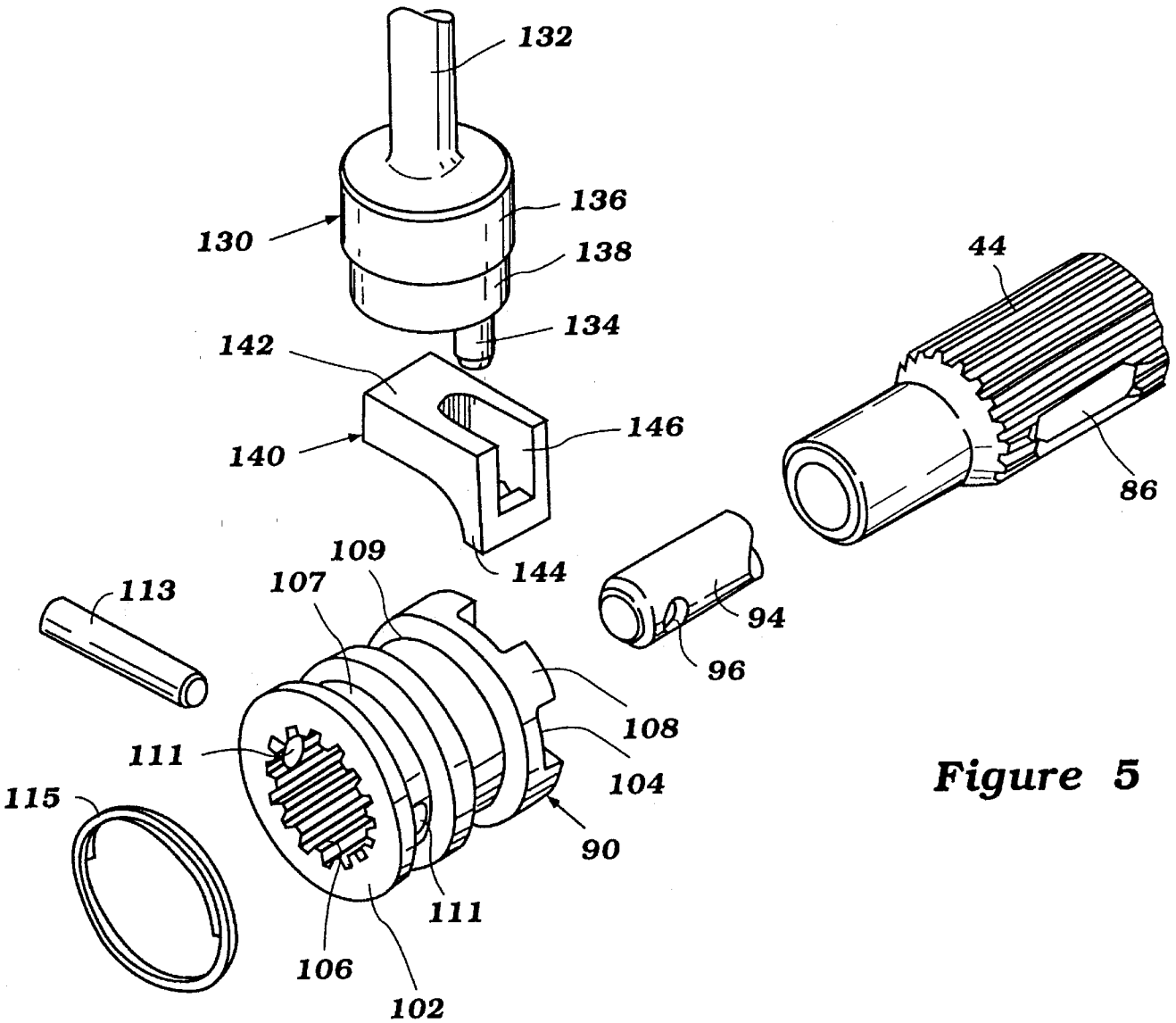
FIG. 5 is an exploded perspective view of the actuator and front clutch assembly of the transmission of FIG. 3.
Figure 6:
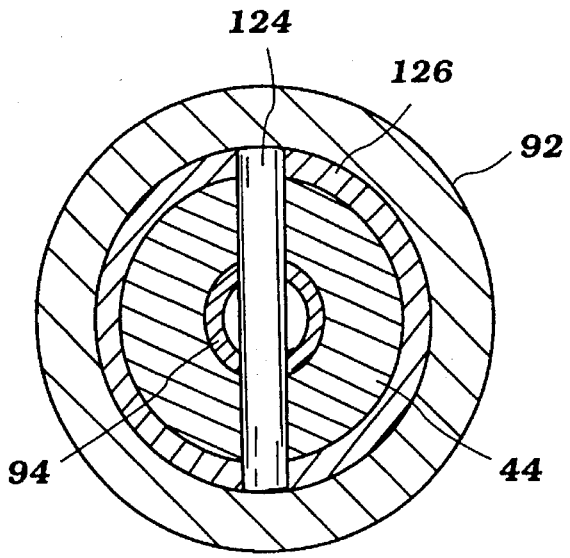
FIG. 6 is a cross-sectional view through a rear clutch of the transmission of FIG. 3 taken along line 6—6.

As seen in FIGS. 3 and 5, the front clutch 90 includes a transverse hole 111 that extends through the clutch 90 at the location of the front annular groove 107. The hole is sized to receive a pin 113 which, when passed through the front aperture 86 of the inner propulsion shaft 44 and through the front hole 96 of the plunger 94, interconnects the plunger 94 and the front clutch 90 with the front clutch 90 positioned on the inner propulsion shaft 44. The pin 113 may be held in place by a press-fit connection between the pin 113 and the front hole 111 of the clutch 90 or by a conventional coil spring 115 (see FIG. 5) which is contained within the front annular groove 107 about the exterior of the front clutch 90.

As seen in FIG. 4, the rear clutch 92 is disposed between the two counter-rotating driven gears 52, 54. The rear dog clutch 92 has a tubular shape that includes an axial bore which extends between an annular front end 110 and an annular rear end 112. The bore 117 is sized to receive a portion of the outer propulsion shaft 46 positioned about the inner propulsion shaft 44.

The annular end surfaces 110, 112 of the rear clutch 92 are substantially coextensive in size with the annular engagement surfaces 63 of the front and rear gears 52, 54, respectively. Teeth 114 extend from the front end 110 of the rear clutch 92 and desirably correspond to the respective teeth 62 of the front gear 52 in size (e.g., axial length), in number, and in configuration. Teeth 116 likewise extend from the rear end surface 112 of the rear clutch 92 and desirably correspond to the respective teeth 72 of the rear gear 54 in size (e.g., axial length), in number, and in configuration.

As seen in FIG. 4, the front engagement end 110 of the rear clutch 92 carries a greater number of teeth than the rear engagement end 112 of the rear clutch 92 and a greater number of teeth than the rear engagement end 104 of the front clutch 90. In the illustrated embodiment, the rear engagement end 104 of the front clutch and the rear engagement end 116 of the rear clutch 92 desirably include the same number of clutching teeth 108, 116, respectively. The front engagement end 114 of the rear clutch 92 desirably includes twice as many teeth 114 than that carried by either the rear engagement end 104 of the front clutch 90 or the rear engagement end 112 of the rear clutch 92. In the manner, the torque load per tooth 114 when the rear clutch 92 engages the front gear 54 is almost half of the torque load per tooth 108, 116 when the front clutch 90 engages the front gear 52 and the rear clutch 92 engages the rear gear 54. In addition, the fewer number of teeth involved where the clutches 90, 92 simultaneously engage the gears 52, 54 eases shifting because registration between the corresponding teeth is achieved quicker.

With reference back to FIG. 3, the rear clutch 92 is splined to the outer propulsion shaft 46. The clutch 92 thus drives the outer propulsion shaft 44 through the spline connection 118 between the rear clutch 92 and the shaft 46, yet the clutch 92 can slide along the axis of the shaft 46 between the front and rear gears 52, 54. The rear clutch 92 specifically includes internal splines within the bore 117 that mate with corresponding external splines 120 on the outer periphery of the outer propulsion shaft 46 to from the spline connection 118.

The rear clutch 92 also includes a counterbore 122. The counterbore 122 is sized to receive a pin 124 which extends through the rear aperture 88 of the inner propulsion shaft 44 and through the rear hole 98 of the plunger 94 when assembled. As seen in FIG. 5, the ends of the pin 124 desirably are captured by an annular bushing 126 which is interposed between a pair of roller bearings (not shown). The assembly of the bushings and bearings is captured between a pair of washers and locked within the counterbore 122 of the dog clutch 92 by a retaining ring (not shown in FIG. 5). The roller bearings journal the bushing and pin 124 assembly within the counterbore 122 of the rear dog clutch 92 to allow the bushing 126 and pin 124 to rotate in an opposite direction from the rear clutch 92. The pin 124, being captured within the counterbore 122 of the rear clutch 92, couples the plunger 94 and the rear clutch 92 together in order for the plunger 94 to actuate the rear clutch 92, as discussed below.

With reference back to FIG. 3, an actuator mechanism 128 moves the plunger 94 of the clutch assembly from a position establishing a forward drive condition, in which the front and rear clutches 90, 92 engage the first and second gears 52, 54, respectively, to a position of non-engagement (i.e., the neutral position) and to a position establishing a reverse drive condition, in which the rear clutch 92 engages the front gear 52. The actuator mechanism 128 positively reciprocates the plunger 94 between these positions. FIGS. 3 and 5 best illustrate an exemplary embodiment of the actuator mechanism 128.

As seen in FIG. 3, the actuator mechanism 124 includes a cam member 130 that connects the plunger 94 to a rotatable shift rod 132. In the illustrated embodiment, the shift rod 132 is journalled for rotation in the lower unit 28 and extends upwardly to a transmission actuator mechanism (not shown). The actuator mechanism 128 converts rotational movement of the shift rod 132 into linear movement of the plunger 94 to move the plunger 94 and the clutches 90, 92 generally along the axis of the propulsion shafts 44, 46.

As best seen in FIG. 5, the cam member 130 is affixed to the lower end of the shift rod 132. The cam member 130 includes an eccentrically positioned drive pin 134 which extends downwardly from the cam member 130. The cam member 128 includes a cylindrical upper bearing 136 and a smaller diameter, cylindrical lower member 138. The upper bearing 136 is positioned to rotate about the axis of the shift rod 132 and as seen in FIG. 3, is suitably journaled within an upper bore of the lower unit 28. The lower member 138 is eccentrically positioned relative to the axis of the shift rod 132 and the upper bearing 136.

FIG. 5 also best illustrates a follower 140 of the actuator mechanism 128. The follower 140 has a generally rectangular block-like body 142 with a retention arm 144 depending from one end. The retention arm 144 advantageously depends from a leading edge of the body 142 relative to the designed rotation of the clutch 90. In the illustrated embodiment, the retention arm 144 depends from the right side of the body 140 where the clutch 90 is designed to rotate in the counter-clockwise direction. As best understood from FIG. 7, the retention arm 144 holds the follower 140 on the clutch 90 with the follower body 142 captured between the clutch 90 in the rear groove 109 and the lower end of the lower cylindrical member 138 of the cam member 130.

Figure 7:
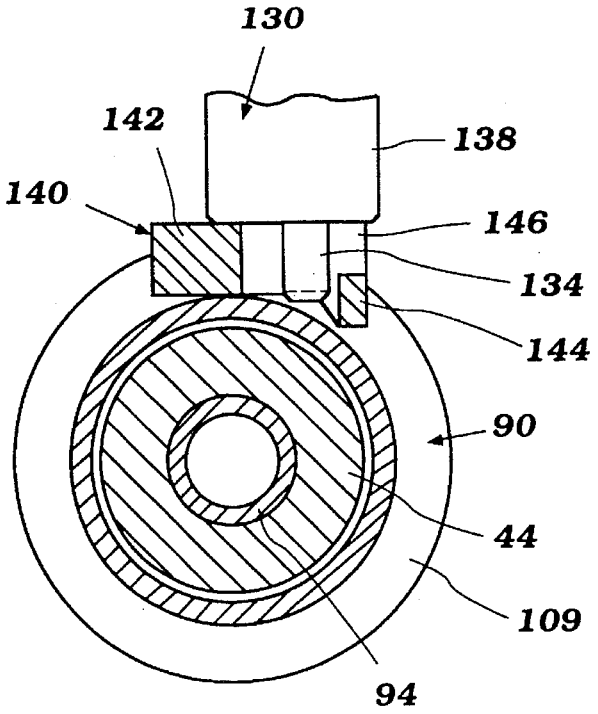
FIG. 7 is a cross-sectional view of a front clutch and actuator of the transmission of FIG. 3 taken along line 7—7.

The follower 140 also includes an aperture 146 which, as best seen in FIG. 5, extends into the body 142 from the end from which the retention arm 144 depends, and, which, as best seen in FIG. 7, extends through the body 142 in a transverse direction. The aperture 146 has a width generally equal to the diameter of the drive pin 134 of the cam member 130. When assembled, as illustrated in FIG. 7, the drive pin 134 extends through the aperture 146 and is captured between the walls of the follower body 142.

As best understood from FIG. 3, the follower body 142 has a width which generally equals the width of the rear annular groove 109 on the exterior of the front clutch 90. And, as best seen in FIG. 7, the follower body 142 has a height which generally matches the depth of the rear annular groove 109 of the front clutch 90. In this manner, the clutch groove 109 receives and captures the follower 140 of the actuated mechanism 128.

The drive pin 134 moves both axially and transversely with rotation of the cam member 130 because of the eccentric position of the drive pin 134 relative to the rotational axis of the cam member 130. The aperture 146 of the follower body 142 thus desirably has a sufficient length to accommodate the transverse travel of the drive pin 132 as the cam member 130 rotates between positions corresponding to the forward and reverse drive conditions. The axial travel of the drive pin 134 causes the follower 140 and the coupled clutch 90 to move axially, sliding over the inner propulsion shaft 52.

With reference to FIG. 3, the front clutch 90 is coupled to the cam member 130 with the follower 140 cradled between the walls of the rear annular groove 109 on the front clutch 90. The actuator mechanism 128 configured accordingly positively moves the front clutch 90 along the axis of the inner propulsion shaft 44 with rotational movement of the cam member 130 operated by the shift rod 132. The coupling between the actuator mechanism 128 and front clutch 90, however, allows the clutch 90 to rotate with the inner propulsion shaft 44 relative to the follower 140 and the cam member 130.

The following elaborates on the previous description of the operation of the present transmission 36. FIG. 3 illustrates the front and rear clutches 90, 92 in a neutral position, i.e., a position of non-engagement with the gears 52, 54. The detent mechanism 99 retains the plunger 94 and the coupled clutches 90, 92 in this neutral position.

To establish a forward drive condition, the shift rod 132 rotates the cam member 130 in a manner which moves the drive pin 134 axially in the reverse direction. In the illustrated embodiment, counterclockwise rotation of the shift rod 132 moves the eccentric driving pin 134 axially in that direction. The follower 140 thus follows the drive pin 134 to slide the front clutch 90 over the inner propulsion shaft 44. The actuator mechanism 128 thereby forces the front clutch 90 into engagement with the front gear 52, with the corresponding clutch teeth 60, 108 mating. So engaged, the front gear 52 drives the inner propulsion shaft 44 through the internal spline connection between the clutch 90 and the inner propulsion shaft 44. The inner propulsion shaft 44 thus drives the rear propeller 40 (FIG. 2) in a first direction which asserts a forward thrust.

The forward motion of the clutch 90 also causes the plunger 94 to slide within the longitudinal bore 84 of the inner propulsion shaft 44 in the reverse direction due to the direct coupling by the drive pin 113. The plunger 94 moves the rear drive pin 124 in the rearward direction to force the rear clutch 92 to engage the rear gear 54 with a corresponding clutching teeth 72, 116 mating. So engaged, the rear gear 54 drives the outer propulsion shaft 46 through the spline connection 118 between the rear clutch 92 and the outer propulsion shaft 46. The outer propulsion shaft 46 thus drives the front propeller 42 (FIG. 2) to spin in an opposite direction to that of the rear propeller 40, and to assert a forward thrust.

With reference back to FIG. 3, to establish a reverse drive condition, the shift rod 132 rotates in an opposite direction so as to move the cam member 130 and the eccentrically positioned drive pin 134 in a direction which moves the drive pin 134 axially in the forward direction. Again, in the illustrated embodiment, clockwise rotation of the shift rod 134 eccentrically rotates the drive pin 134 so as to move the drive pin axially in the forward direction. The forward movement of the drive pin 134 is transferred to the plunger 94 through the follower 140, the clutch 90, and the corresponding drive pin 113. The forward motion of the plunger 94 positively forces the rear clutch 92 into engagement with the front gear 52 with the corresponding clutching teeth 62,114, mating. So engaged, the front gear 52 drives the outer propulsion shaft 44 through the spline connection 118 between the rear clutch 92 and the outer propulsion shaft 44. The outer propulsion shaft 44 thus drives the front propeller 42 (FIG. 2) in a direction which asserts a reverse thrust to propel the watercraft 14 (FIG. 1) in reverse.

The present outboard drive 10 is capable of producing a sufficient thrust to drive the watercraft in a reverse direction by rotating the forward propeller 42 rather than the rear propeller 40 when under a reverse drive condition. Unlike prior transmissions, the second propeller (i.e., the rear propeller 40) does not block the flow of water through the front propeller 42 when the propulsion device 38 is operated in reverse.

FIGS. 8–11 illustrate additional preferred embodiments of the present transmission with component variations relating to the bearing assemblies for the driven gears, to the actuator mechanism used with the transmission, and to the coupling arrangement between the clutching elements of the transmission. The embodiments illustrated by these figures, however, are otherwise identical to the transmission 36 described above. Accordingly, the foregoing description of the transmission should be understood as applying equally to the embodiments illustrated in FIGS. 8–11, unless specified to the contrary.

Figure 8:
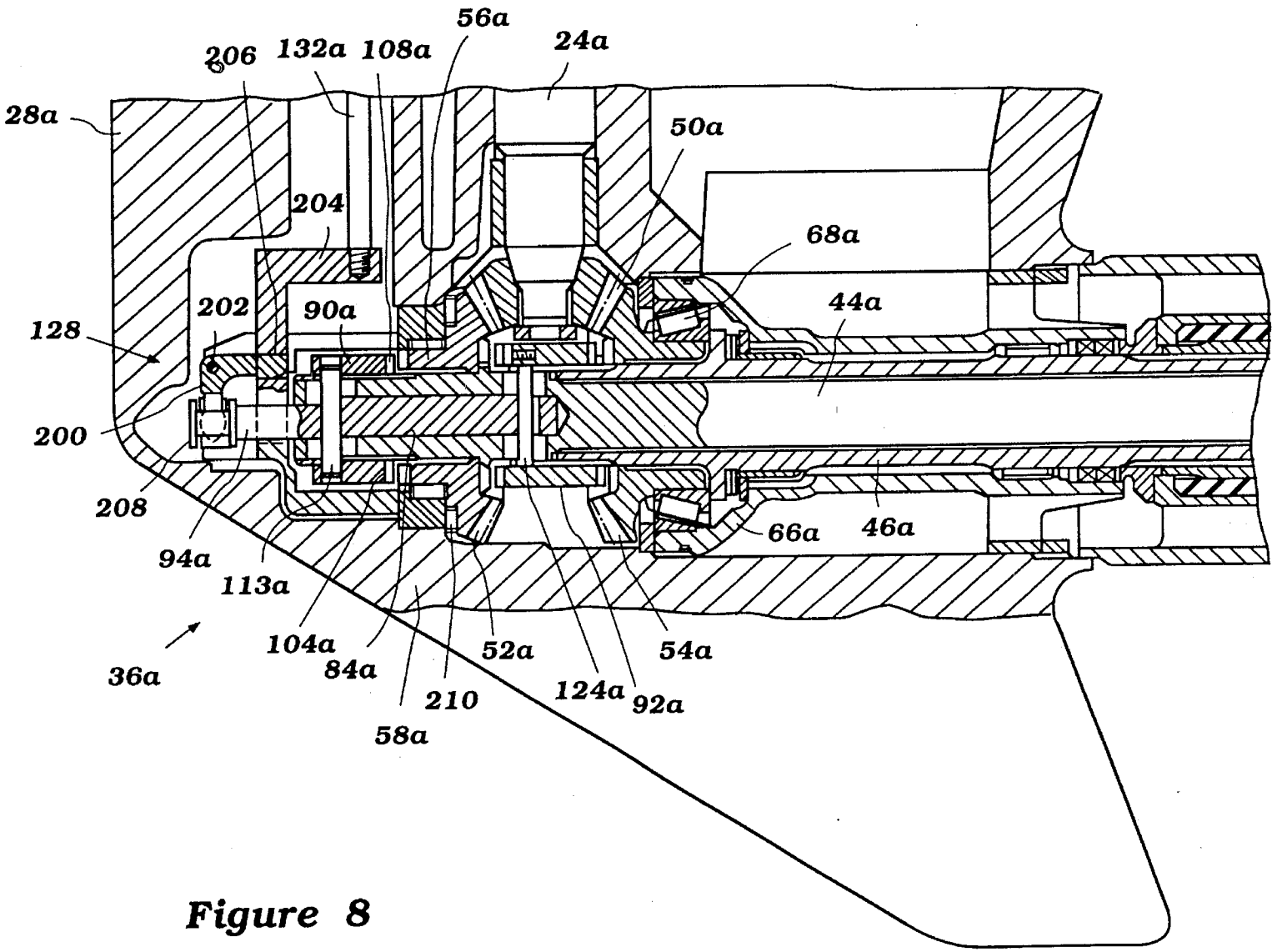
FIG. 8 is an enlarged sectional side elevational view of a transmission of a lower unit of a marine outboard drive configured in accordance with another preferred embodiment of the present invention.

FIG. 8 illustrates an alternative embodiment of the present transmission which is actuated by another type of actuator mechanism. Where appropriate, like numbers with an "a" suffix have been used to indicate like parts of the two embodiments for ease of understanding.

As seen in FIG. 8, the actuator mechanism 128*a* involves a conventional bell crank mechanism that includes a bell crank 200. A pin 202 supports the bell crank 200 in a manner that allows the bell crank 200 to pivot about the pin 202.

An arm 204 connects one end of the bell crank 200 to a lower end of the shift rod 132*a*. An aperture 206 formed in the lower portion of the arm 204 receives the end of the bell crank 200 in a manner which allows the bell crank end to rotate within the aperture 206 when operating the bell crank 200, as known in the art.

A follower 208 captures the lower end of the bell crank 200 in a manner which allows the lower end to rotate relative to the follower 208. The follower 208 is rotatably coupled to a plunger 94*a*. The rotatable coupling between the follower 208 and the plunger 94*a* allows the plunger 94*a* to rotate relative to the follower 208.

In the illustrated embodiment, the plunger 94*a* is a solid rod which slides within a bore 84*a* of an inner propulsion shaft 44*a*. The front end of the plunger 94*a* projects beyond the front end of the inner propulsion shaft 44*a* to couple with the follower 208 in front of the inner shaft 44*a*. The plunger 94*a* carries the drive pins 113*a*, 124*a* which coupled the front and rear clutches 90*a*, 92*a* to the plunger 94*a*.

The front clutch 90*a* in the present embodiment has a simplified configuration from that shown in FIG. 3. In the illustrated embodiment, the front clutch 90*a* generally has a sleeve-like body with clutching teeth 108*a* formed on a rear engagement end 104*a*. The clutch 90*a* is sized and configured to engage the clutching element carried on the front side of the front gear 52*a*.

Vertical movement of the shift rod 132*a* rotates the bell crank 200, which in turn moves the follower 208 and the coupled plunger 94*a* along the axis of the inner propulsion shaft 44*a*. In the illustrated embodiment, upward movement of the shift rod 132*a* establishes a forward drive condition in which the front clutch 90*a* engages the front gear 52*a* and the rear clutch 92*a* engages the rear gear 54*a*.

FIG. 8 also illustrates another bearing assembly arrangement to support the front gear 52*a*. In the illustrated embodiment, a needle bearing assembly 58*a* journals the hub 56*a* of the front gear 52*a* within the lower unit 28*a*. Thrust bearings 210 also are positioned between the front gear 52*a* and the lower unit 28*a* to take the trust loading on the front gear 52*a*.

Figure 9:
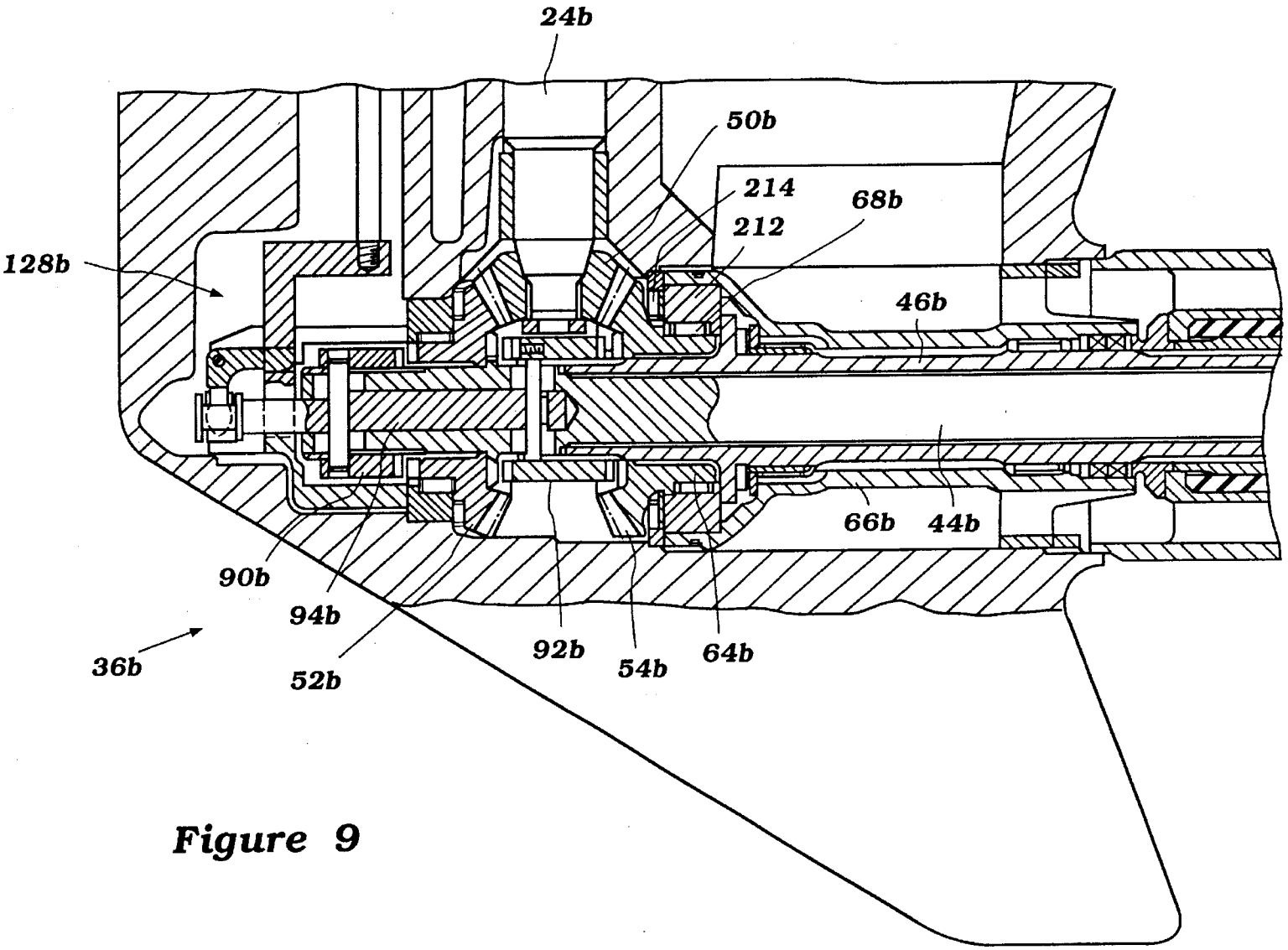
FIG. 9 is an enlarged sectional side elevational view of a transmission of a lower unit of a marine outboard drive configured in accordance with an additional preferred embodiment of the present invention.

FIG. 9 illustrates an additional embodiment of the present transmission system which is substantially identical to the transmission illustrated in FIG. 8, except for the bearing assembly which supports the rear driven gear. Where appropriate, like reference numerals with a "b" suffix have been used to indicate like components between these embodiments.

As seen in FIG. 9, a rear needle bearing assembly 68*b* journals the hub 64*b* of the rear gear 54*b* within the bearing casing 66*b*. A closure plate 212 supports the needle bearing assembly 68*b* within an enlarged forward portion of the bearing casing 66*b* to function as an outer race of the bearing assembly 68*b*. Needle-like thrust bearings 214 also are positioned between the rear gear 54*b* and the closure plate 212 to take the trust loading on the rear gear 54*b*.

Figure 10:
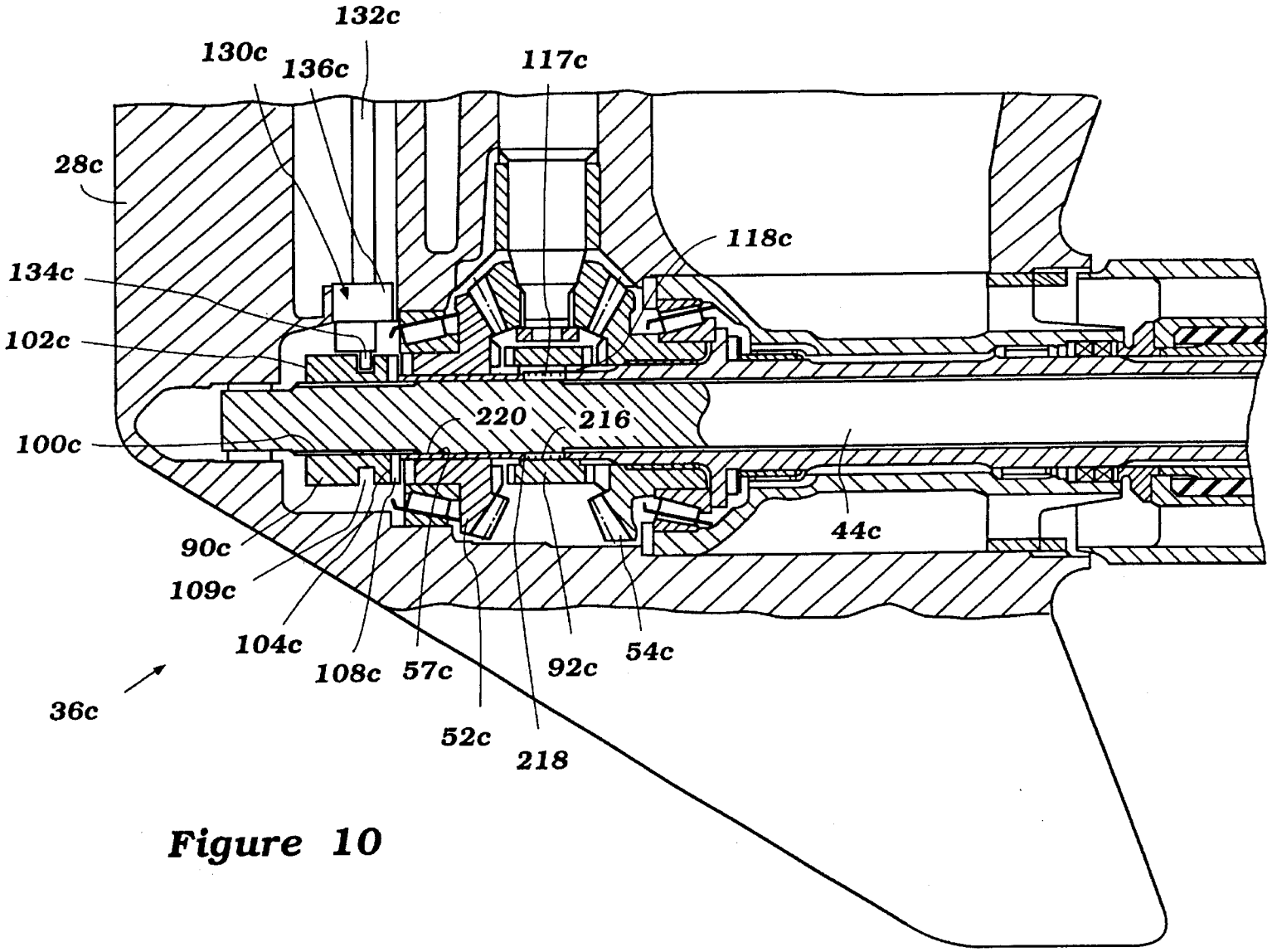
FIG. 10 is an enlarged sectional side elevational view of transmission of a marine outboard motor configured in accordance with yet another preferred embodiment of the present invention.

FIG. 10 illustrates an another embodiment of the present transmission. The transmission illustrated in FIG. 10 is substantially identical the transmission illustrated in FIG. 3 with the exception of the actuator mechanism and the coupling between the clutches. Where appropriate, like reference numerals with a "c" suffix have been used to indicate like components between these embodiments.

As seen in FIG. 10, the front clutch 90*c* of the transmission 36*c* has a generally tubular shape and defines an inner bore 110*c* between a front end 102*c* and a rear engagement end 104*c*. The rear engagement end 104*c* carries a plurality of teeth 108*c* to engage the front side of the front gear 52*c*. The inner bore 100*c* receives the inner propulsion shaft 44*c* when assembled, and includes a plurality of interior splines which extend from the wall of the inner bore 106*c*. The inner splines mate with external splines on the exterior of the inner propulsion shaft 44*c* to establish a spline connection between these components 44*c*, 90*c*. The clutch 90*c* thus can slide axially over the inner propulsion shaft 44*c* and can rotatably drive the shaft 44*c*.

A cam member 130*c* connects the front clutch 90*c* to a rotatable shift rod 132*c*. The shift rod 132*c* is journalled for rotation in the lower unit 28*c* and extends upwardly to a transmission actuator mechanism (not shown) for reciprocating the cam member 130*c* and the front clutch 90*c* between the neutral position (shown in FIG. 10), a forward drive position where the front and rear clutches 90*c*, 92*c* engage the front and rear gears 52*c*, 54*c*, respectively, and a reverse drive position where the rear clutch 92*c* engages the front gear 52*c*.

The cam member 130*c* is affixed to the lower end of the shift rod 132*c*. The cam member 130*c* includes an eccentrically positioned drive pin 134*c* which depends from a cylindrical lower member of the cam member 130*c*. The cam member 130*c* also includes a cylindrical upper bearing 136*c* which is suitably journaled within the lower unit 28*c*, as known in the art. The drive pin 134*c* is eccentrically positioned in relation to the axis of rotation of the shift rod 132*c*.

The front clutch 90c includes an annular groove 109c which circumscribes the tubular body of the clutch 90c. The width of the groove 109c substantially matches the diameter of the drive pin 134c. When assembled, as seen in FIG. 10, the drive pin 134c extends into the groove 109c and is captured between the side wall of the groove 109c. The drive pin 134c, however, does not interfere with the rotation of the clutch 90c which freely rotates relative to the cam member 130c when in the forward drive position.

As understood from FIG. 10, the drive pin 134c moves both axially and transversely with the rotation of the cam member 130c because of the eccentric position of the drive pin 134c relative to the rotational axis of the cam member 130c. For this purpose, the drive pin 134c freely moves within the groove 109c in the transverse direction while maintain engagement with the front clutch 90c. The axial travel of the drive pin 134c causes the front clutch 90c to move axially, sliding over the inner propulsion shaft 44c.

The rear clutch 92c also has a tubular body which defines an inner bore 117c. The inner bore 117c extends between front and rear engagement ends 110c, 112c, each of which carry a plurality of clutching teeth 114c, 116c configured to engage the corresponding clutching teeth 60c, 72c of the front and rear driven gears 52c, 54c. The inner bore 117c has a sufficient size to receive the inner propulsion shaft 44c and a portion of the outer hollow propulsion shaft 46c which is coaxially positioned about the inner propulsion shaft 44c. Internal splines extend from the wall of the inner bore 117c proximate to the rear engagement end 112c of the clutch 92c, and mate with corresponding external splines on the exterior of the outer propulsion shaft 46c. The internal splines extend only partially over the axial length of the inner bore 117c. The spline connection 118c drivingly connects the clutch 92c to the outer propulsion shaft 46c, while allowing the clutch 92c to slide over the outer propulsion shaft 46c for operation, as explained below.

A biasing member 216 is disposed within the inner bore 117c and extends between the front end of the outer propulsion shaft 46c and a retaining washer 218 fixed to the rear clutch 92c at the front end of the inner bore 117c. In the illustrated embodiment, the biasing member 216 comprises a helical compression spring which slips over the inner propulsion shaft 44c and operates within the inner bore 117c, as described below. The biasing member 216 desirably is compressed in the neutral position to assert a forward biasing force on the rear clutch 92c.

A clutch actuation mechanism couples the clutches 90c, 92c together for simultaneous operation. The clutch actuation mechanism includes a bushing sleeve 220 which passes through an inner bore 57c of the front gear 52c and surrounds a portion of the inner propulsion shaft 44c in this position. The bushing 220 is sized to smoothly slide over the inner propulsion shaft 44c and through the inner bore 57c of the front gear 52c, as discussed below. In the illustrated embodiment, the bearing sleeve 220 desirably is fixed to the inner shaft 44c in a manner which allows the sleeve 220 to slide over the shaft 44c in the forward and rearward directions, but which causes the sleeve 220 to rotate with the inner shaft 44c. The bushing 220 thus journals the shaft 44c within the inner bore 57c of the front gear 52c.

The bushing 220 extends between a rear engagement surface 104c of the front clutch 90c and the retaining washer 218 at the front end 110c of the rear clutch 92c, and contacts the clutches 90c, 92c in a manner which does not interfere with the clutching operation and the front and rear clutches 90c, 92c.

The following elaborates on the previous description of the operation of the present transmission 36c. FIG. 10 illustrates the front and rear clutches 90c, 92c in a neutral position. The bearing sleeve 220 acts as a spacer between the front and rear clutches 90c, 92c and prevents the rear clutch 92c from moving in the forward direction, despite the bias in this direction produced by the biasing member 216. The biasing member 216 urges the retaining washer 218 of the rear clutch 92c into contact with the bearing sleeve 220, and inhibits movement of the rear clutch 92c in the rearward direction. In this manner, the combination of the bearing sleeve 220 and the biasing member 216 couple the rear clutch 92c with the front clutch 90c such that these clutching elements move together, as well as maintain the position of the rear clutch 92c relative to the front clutch 90c.

To establish the forward drive condition, the shift rod 132c rotates the cam member 130c in a manner which moves the drive pin 134c axially in the rearward direction. The drive pin 134c moves the front clutch 90c rearward to slide the front clutch 90c over the inner propulsion shaft 44c and force the front clutch 90c into engagement with the front gear 52c with the corresponding clutching teeth 72, 116 mating. So engaged, the front clutch 90c drives the inner propulsion shaft 44c through the spline connection between the clutch 90c and the inner propulsion shaft 44c. The inner propulsion shaft 44c thus drives the rear propeller 40c in a first direction to assert a forward thrust.

As understood from FIG. 10, forward motion of the front clutch 90c also slides the bearing sleeve 220 over the inner propulsion shaft 44c and through the front gear 52c to actuate the rear clutch 92c. The bearing sleeve 220 thus positively forces the rear clutch 92c to engage the rear gear 54c with the corresponding clutching teeth 72c, 116c mating. So engaged, the rear clutch 92c drives the outer propulsion shaft 46c through the spline connection 118c between the rear clutch 92c and the outer propulsion shaft 46c. The outer propulsion shaft 46c in turn drives the front propeller 42c to spin in an opposite direction to that of the rear propeller 40c and to assert a forward thrust.

To establish a reverse drive condition, the shift rod 132c rotates to move the drive pin 134c and front clutch 90c in the forward direction. The preloaded biasing member 216 urges the rear clutch 92c to follow the forward motion of the front clutch 90c. The bearing sleeve 220 slides over the inner shaft 44c between the clutches 90c, 92c as the clutches 90c, 92c simultaneously move in the forward direction. The biasing member 216 forces the rear clutch 92c into engagement with the rear clutching surface 61c of the front gear 52c. The corresponding teeth 62c, 114c of the front gear 52c and the rear clutch 92c mate to establish a drive condition between these elements. So engaged, the front gear 52c drives the outer propulsion shaft 46c through the spline connection 118c between the rear clutch 92c and the outer propulsion shaft 46c. The outer propulsion shaft 46c thus drives the front propeller 42c to spin in a direction to assert a rearward thrust and drive the watercraft 14c in reverse.

Figure 11:
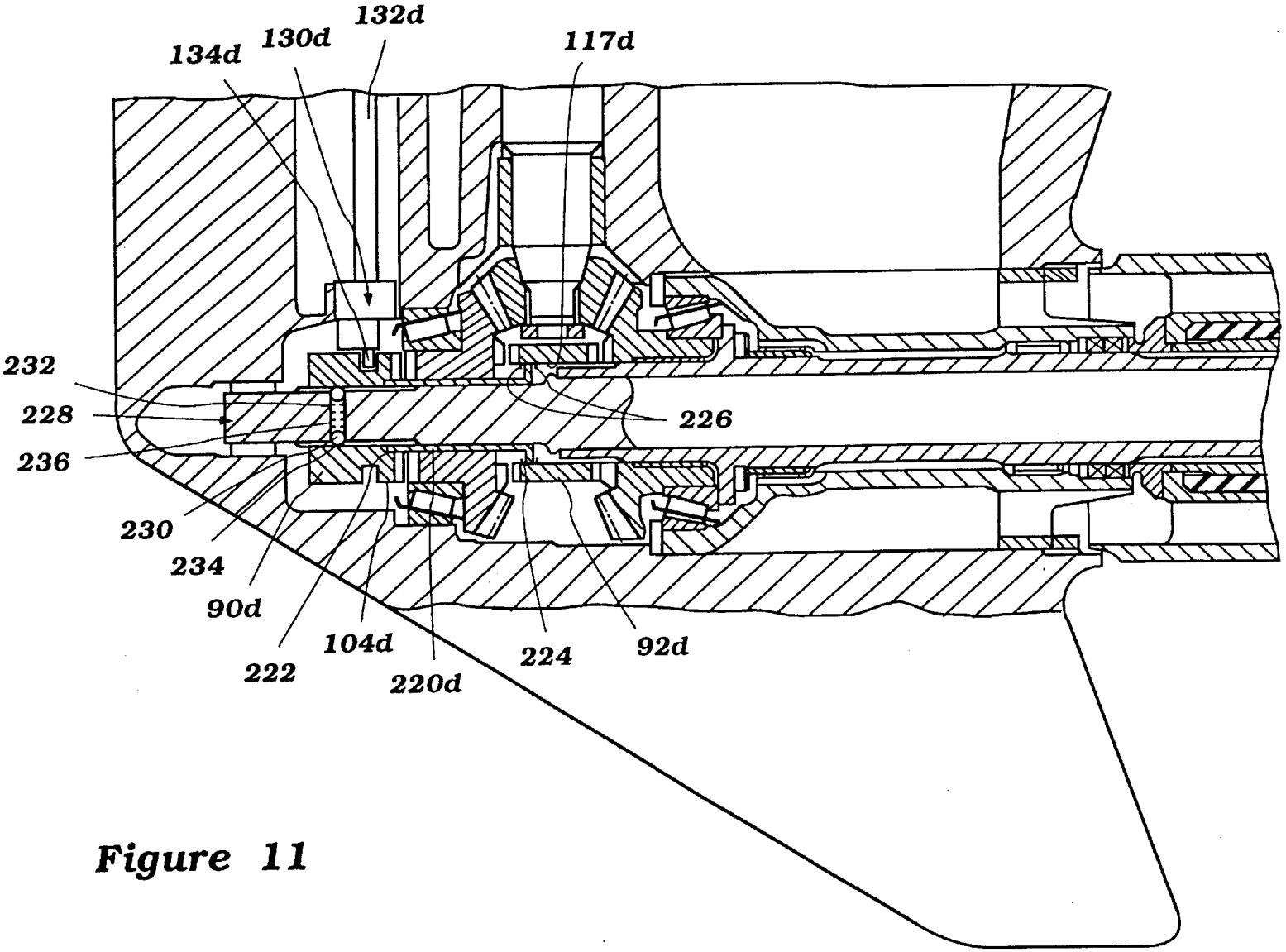
FIG. 11 is an enlarged sectional side elevational view of a transmission of a lower unit of a marine outboard motor configured in accordance with a further preferred embodiment of the present invention.

FIG. 11 illustrates an additional embodiment of the present transmission system which is substantially identical to the embodiment illustrated in FIG. 10 except for the clutch coupling mechanism between the front and rear clutches and for the addition of a neutral detent mechanism. Where appropriate, like reference numerals with a "d" suffix have been used to indicate like components between these embodiments.

As seen in FIG. 11, the ends of the bearing sleeve 220d are fixed to the front and rear clutches 90d, 92d. The front clutch

90*d* includes a counterbore 222 which extends into the tubular body of the clutch 90*d* from its front engagement end 104*d*. The counterbore 222 is sized so as to create an interference fit with the front end of the bearing sleeve 220*d*. This coupling interconnects the front clutch 90*d* and the bearing sleeve 220*d* without interfering with the ability of these elements slide over the inner propulsion shaft 44*d*. The coupling also eliminates the need for additional fasteners so as to simplify assembly and disassembly.

The rear end of the bearing sleeve 220*d* is captured within the inner bore 117*d* of the rear clutch 92*d* at its front end 110*d*. In the illustrated embodiment, the bearing sleeve 220*d* includes a flared rear end 224 which is captured between a pair of retaining washers 226 which are detachably fixed within the inner bore 117*d* of the rear clutch 92*d*. The rear clutch 92*d* can rotate relative to the bearing sleeve 220*d* with the flared rear end 224 of the bearing sleeve 220*d* captured between, but not attached to the washers 226. The flared end 224 can freely rotate within the space defined between the washers 226 and the inner bore 117*d* of the rear clutch 92*d*.

The bearing sleeve 220*d* links the clutches 90*d*, 92*d* together with its ends coupled to the clutches 90*d*, 92*d*. The bearing sleeve 220*d* thus causes the rear clutch 92*d* to follow the movement of the front clutch 90*d*.

The present transmission 36*d* also includes a neutral detent mechanism 228 to retain the front clutch 90*d* in the neutral position. In the illustrated embodiment, the neutral detent mechanism 228 is formed by a plurality of detent balls 230 positioned within a transverse hole 232 in the inner propulsion shaft 44*d*. The detent balls 230 cooperate with an annular groove 234 formed within the inner bore 100*d* of the front clutch 90*d*. A compression spring 236 urges the detent balls 230 to partially protrude beyond the outer surface of inner propulsion shaft 44*d* and to engage the annular groove of the front clutch 90*d*, as known in the art.

To establish a forward drive condition, the shift rod 132*d* rotates the cam member 130*d* in a manner which moves the drive pin 134*d* axially in the rearward direction. The drive pin 134*d* moves the front clutch 90*d* rearward to slide the front clutch 90*d* over the inner propulsion shaft 44*d* and to force the front clutch 90*d* into engagement with the front gear 52*d* with the corresponding clutching teeth 60*d*, 108*d* mating. So engaged, the front clutch 52*d* drives the inner propulsion shaft 44*d* through the spline connection between the clutch 90*d* and the inner propulsion shaft 44*d*. The inner propulsion shaft 44*d* thus drives the rear propeller 40*d* in a first direction to assert a forward thrust.

As understood from FIG. 11, forward motion of the front clutch 90*d* also slides the bearing sleeve 220*d* over the inner propulsion shaft 44*d* and through the front gear 52*d* to actuate the rear clutch 92*d*. The bearing sleeve 220*d* thus positively forces the rear clutch 92*d* to engage the rear gear 92*d* with the corresponding clutching teeth 72*d* 116*d* mating. So engaged, the rear clutch 92*d* drives the outer propulsion shaft 46*d* through the spline connection 118*d* between the rear clutch 92*d* and the outer propulsion shaft 44*d*. The outer propulsion shaft 46*d* in turn drives the front propeller 42*d* to spin in an opposite direction to that of the rear propeller 40*d* and to assert a forward thrust.

To establish a reverse drive condition, the shift rod 132*d* rotates to move the drive pin 134*d* and front clutch 90*d* in the forward direction. Rearward motion of the front clutch 90*d* also slides the bearing sleeve 220*d* over the inner propulsion shaft 44*d* and through the front gear 52*d* to actuate the rear clutch 92*d* in this direction. The bearing sleeve 220*d* thus positively pulls the rear clutch 92*d* to engage the front gear 52*d*. The corresponding teeth 60*d*, 114*d* of the front gear 52*d* and the rear clutch 92*d* mate to establish a drive condition. So engaged, the front gear 52*d* drives the outer propulsion shaft 46*d* through the spline connection 118*d* between the rear clutch 92*d* and the outer propulsion shaft 46*d*. The outer propulsion shaft 46*d* thus drives the front propeller 42*d* to spin in a direction to assert a rearward thrust and drive the watercraft in reverse.

As common to all of the embodiments described above, the clutching mechanism of the transmission lies forward of the rear gear so as to reduce the axial length of the transmission. This configuration thus provides more space within the lower unit behind the transmission. The increased flow area behind the transmission at the transition of the exhaust discharge duct within the lower unit to the exhaust discharge passage formed through the propellers allows for a smoother discharge of exhaust gases from the engine. The increase flow area also increases the capacity of the exhaust system of the outboard motor to accommodate larger engines.

The present transmission design also drives the front propeller, rather than the rear propeller, when operated under a reverse drive condition. As noted above, the thrust stream from the front propeller is not blocked by another propeller as with prior designs. The efficiency of the propulsion device when operated in reverse thus is improved.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A transmission for a watercraft outboard drive which selectively couples a drive shaft of the outboard drive to first and second propulsion shafts, each propulsion shaft extending from said transmission to drive a propulsion device along a common axis, said transmission comprising first and second counter-rotating gears driven by the drive shaft, a first clutch element connected to said first propulsion shaft on a side of said first and second gears opposite of the propulsion devices, a second clutch element connected to said second propulsion shaft and coupled to said first clutch, said second clutch interposed between said first and second gears, and a shift operator directly connected to said first clutch element and arranged adjacent to said first clutch element at the same general location along the propulsion shaft axis at which said first clutch element lies.

2. The transmission of claim 1 additionally comprising an actuator coupled to said first and second clutch elements, said actuator configured to reciprocate said clutch elements between a first drive position, in which said first clutch element engages said first gear and said second clutch element engages said second gear, to a second drive position in which said second clutch element engages said first gear.

3. The transmission of claim 2, wherein said actuator is a plunger which carries said first and second clutch elements for simultaneously actuation.

4. The transmission of claim 2, wherein said actuator is a bearing sleeve positioned between said first and second clutch elements and adapted to slide over said first propulsion shaft, said sleeve being coupled to said first and second clutch elements.

5. The transmission of claim 4 additionally comprising a biasing member which acts upon said second clutch element on a side opposite of that on which said bearing sleeve contacts said second clutch element.

6. The transmission of claim 2, wherein said second clutch element includes a first portion which engages said second gear in said first drive position and a second portion which engages said first gear in said second drive position, said second portion having a greater number of clutching teeth than said first portion of said second clutch element.

7. The transmission of claim 1, wherein said first propulsion shaft drives a first propulsion device and said second propulsion shaft drives a second propulsion device, said second propulsion device being positioned between said first propulsion device and said transmission.

8. The transmission of claim 1, wherein said first and second clutch elements are positive-contact clutches.

9. The transmission of claim 1, wherein said first and second gears are bevel-type gears.

10. The transmission of claim 1, wherein said second propulsion shaft is hollow and is concentrically positioned about said first propulsion shaft so as to be coaxial.

11. The transmission of claim 1, wherein said shift operator includes a rotatable a shift rod which extends along an axis which is generally perpendicular to the axis along which said first clutch element slides.

12. The transmission of claim 11, wherein said shift operator additionally includes an actuator mechanism which converts rotational movement of said rotatable shift rod into axial movement of said first clutch element along said propulsion shaft axis, said actuator mechanism comprising an eccentric member which is eccentrically positioned relative to the rotational axis of said shift rod.

13. The transmission of claim 12, wherein said eccentric member cooperates with an annular groove which circumscribes a portion of said first clutch element.

14. The transmission of claim 13, wherein a follower of said actuator mechanism lies at least partially within said annular groove of said first clutch element and receive at least a portion of said eccentric member.

15. A transmission for a watercraft outboard drive, said transmission comprising first and second counter-rotating gears, a first clutch element interposed between said first and second gears, a second clutch element coupled to said first clutch element and positioned on a side of one of said gears opposite of said first clutch element, an actuator coupling together said clutch elements, said actuator being positioned adjacent to said second clutch element on a side of one of said gears opposite of said first clutch element, and a rotatable shift operator connected to said second clutch element independent of said actuator, said shift operator including an actuator mechanism which converts rotational movement of a member of said shift operator into axial movement of said first clutch element along said propulsion shaft axis.

16. The transmission of claim 15, wherein said first clutch element is connected to a first propulsion shaft and said second clutch element is connected to a second propulsion shaft.

17. The transmission of claim 16, wherein said actuator is configured to reciprocate said clutch elements between a first drive position, in which said first clutch element engages said first gear and said second clutch element engages said second gear, to a second drive position in which said first clutch element engages said second gear.

18. The transmission of claim 17, wherein said actuator is a plunger which carries said first and second clutch elements for simultaneously actuation.

19. The transmission of claim 17, wherein said actuator is a bearing sleeve-positioned between said first and second clutch elements and adapted to slide over said second propulsion shaft, said sleeve being coupled to said first and second clutch elements.

20. The transmission of claim 19 additionally comprising a biasing member which acts upon said first clutch element on a side opposite of that on which said bearing sleeve contacts said first clutch element.

21. A transmission for a outboard drive comprising first and second counter-rotating gears and first and second clutches which selectively engage said gears, said clutches adapted to reciprocate between a first position where said first and second clutches engage said first and second gears, respectively, to a second position where only said first clutch engages said second gear, said first clutch having fewer clutching teeth on a first portion of said first clutch which engages said first gear in said first position than on a second portion of the first clutch which engages said second gear in said second position.

22. The transmission of claim 21, wherein said second portion of said first clutch has at least twice as many clutching teeth than said first portion.

23. The transmission of claim 21, wherein said second clutch has an equal number of clutching teeth to the number of clutching teeth carried by said first portion of said first clutch.

24. The transmission of claim 21, wherein said first clutch is coupled to a first propulsion device and said second clutch is coupled to a second propulsion device.

25. The transmission of claim 24, wherein said first clutch lies between said first and second counter-rotating gears, and said second clutch lies on a side of said first and second counter-rotating gears which is opposite the side on which said propulsion devices lie.

26. The transmission of claim 21 additionally comprising an actuator coupled to said first and second clutches such that said first and second clutches move together.

27. The transmission of claim 26, wherein said actuator is a bearing sleeve positioned between said first and second clutches and adapted to slide over a first propulsion shaft, said sleeve being coupled to said first and second clutches.

28. The transmission of claim 27 additionally comprising a biasing member which acts upon said first clutch on a side opposite of that on which said bearing sleeve contacts said first clutch.

* * * * *